US011867176B1

(12) United States Patent
Shakirov et al.

(10) Patent No.: US 11,867,176 B1
(45) Date of Patent: Jan. 9, 2024

(54) METHOD AND APPARATUS FOR A SUBMERSIBLE MULTISTAGE LABYRINTH-SCREW PUMP

(71) Applicant: Lex Submersible Pumps FZE Company, Moscow (RU)

(72) Inventors: Anton Shakirov, Moscow (RU); Vitaly Koropetskiy, Moscow (RU); Iaroslav Alekseev, Moscow (RU); Vadim Batalov, Moscow (RU)

(73) Assignee: Lex Submersible Pumps FZE Company, Umm Al Quwain (AE)

( * ) Notice: Subject to any disclaimer, the term of this patent is extended or adjusted under 35 U.S.C. 154(b) by 0 days.

(21) Appl. No.: 17/717,889

(22) Filed: Apr. 11, 2022

Related U.S. Application Data

(60) Provisional application No. 63/298,734, filed on Jan. 12, 2022, provisional application No. 63/283,340,
(Continued)

(51) Int. Cl.
*F04C 18/107* (2006.01)
*F04C 23/00* (2006.01)
(Continued)

(52) U.S. Cl.
CPC ..... *F04C 18/107* (2013.01); *E21B 43/121* (2013.01); *F04C 23/001* (2013.01);
(Continued)

(58) Field of Classification Search
CPC .... F04C 18/107; F04C 23/001; F04C 27/008; F04C 29/12; F04C 2240/10;
(Continued)

(56) References Cited

U.S. PATENT DOCUMENTS 2,845,551 A * 7/1958 Potter ..... H02K 5/132 310/87
3,802,803 A * 4/1974 Bogdanov ..... F04B 47/06 418/48
(Continued)

FOREIGN PATENT DOCUMENTS

CN 205370963 U * 7/2016
CN 208221130 U 12/2018
(Continued)

OTHER PUBLICATIONS

Axial Thrust, Link: https://www.ksb.com/centrifugal-pump-lexicon/axial-thrust/191862/.
(Continued)

*Primary Examiner* — Dominick L Plakkoottam
*Assistant Examiner* — Paul W Thiede
(74) *Attorney, Agent, or Firm* — G. Michael Roebuck, PC

(57) ABSTRACT

An apparatus for a submersible screw pump includes a cylindrical rotor located inside of a cylindrical stator. The rotor has a screw thread formed in an opposite direction in relation to screw threads of the stator. The external surface of the rotor has a curvilinear shape and the internal surface of the stator has semicircular shapes without rectangular edges. These surface features of the rotor and stator obtain high speed performance for the apparatus with reduced vortices. A gap between the internal surface of the stator and the external surface of the rotor is 0.1-0.2 millimeters. A unloading thrust bearing is attached to a rotor shaft positioned between an intake thrust bearing and the intake end of the rotor. A cavity in the unloading thrust bearing is configured to receive production fluid from the discharge end of the rotor.

11 Claims, 8 Drawing Sheets

Related U.S. Application Data filed on Nov. 26, 2021, provisional application No. 63/283,342, filed on Nov. 26, 2021, provisional application No. 63/283,343, filed on Nov. 26, 2021, provisional application No. 63/175,596, filed on Apr. 16, 2021.

(51) Int. Cl.

| | |
|---|---|
| ***F04C 27/00*** | (2006.01) |
| ***F04C 29/12*** | (2006.01) |
| ***E21B 43/12*** | (2006.01) |
| ***F04D 17/12*** | (2006.01) |
| ***F04D 29/42*** | (2006.01) |
| ***F04D 29/16*** | (2006.01) |
| ***F04D 29/057*** | (2006.01) |
| ***F04D 3/02*** | (2006.01) |

(52) U.S. Cl.

CPC ..... *F04C 27/008* (2013.01); *F04C 29/12* (2013.01); *F04D 17/12* (2013.01); *F04D 29/057* (2013.01); *F04D 29/162* (2013.01); *F04D 29/4213* (2013.01); *F04C 2240/10* (2013.01); *F04C 2240/20* (2013.01); *F04C 2240/30* (2013.01); *F04C 2240/50* (2013.01); *F04C 2240/54* (2013.01); *F04C 2240/60* (2013.01); *F04C 2240/802* (2013.01); *F04D 3/02* (2013.01)

(58) Field of Classification Search

CPC ..... F04C 2240/20; F04C 2240/30; F04C 2240/50; F04C 2240/54; F04C 2240/60; F04C 2240/802; E21B 43/121; F04D 17/12; F04D 29/057; F04D 29/162; F04D 29/4213; F04B 47/06

See application file for complete search history.

(56) References Cited

U.S. PATENT DOCUMENTS

| | | | | |
|---|---|---|---|---|
| 6,929,064 | B1 * | 8/2005 | Susman | F04C 15/0038 417/462 |
| 8,696,331 | B2 | 4/2014 | Cunningham | |
| 8,770,271 | B2 | 7/2014 | Fielder et al. | |
| 9,242,032 | B2 | 1/2016 | LaRose et al. | |
| 10,584,566 | B2 | 3/2020 | Crane et al. | |
| 2004/0096320 | A1 | 5/2004 | Yevtushenko | |
| 2009/0098003 | A1 | 4/2009 | Srinivasa | |
| 2013/0136639 | A1 * | 5/2013 | Simpson | F04D 5/002 418/55.1 |
| 2020/0072226 | A1 | 3/2020 | Villarreal | |

FOREIGN PATENT DOCUMENTS

| | | | | |
|---|---|---|---|---|
| RU | 2376505 | C2 | 12/2009 | |
| RU | 2657279 | C1 * | 6/2018 | E21B 41/0085 |
| RU | 2726977 | C1 | 7/2020 | |
| RU | 202692 | U1 | 3/2021 | |
| WO | WO-2006115434 | A1 * | 11/2006 | F01C 1/3568 |
| WO | WO-2019041681 | A1 * | 3/2019 | E21B 43/12 |

OTHER PUBLICATIONS

Cylindrical roller thrust bearings; Link: https://www.skf.com/group/products/rolling-bearings/roller-bearings/cylindrical-roller-thrust-bearings.

Xia, B. et al., Investigation of axial thrust deviation between the theory and experiment for high-speed mine submersible pump; Advances in Mechanical Engineering; 2018, vol. 10(8); pp. 1-13; DOI: 10.1177/1687814018789256 Link: https://journals.sagepub.com/doi/pdf/10.1177/1687814018789256.

* cited by examiner

METHOD AND APPARATUS FOR A SUBMERSIBLE MULTISTAGE LABYRINTH-SCREW PUMP

CROSS REFERENCE TO RELATED APPLICATIONS

This patent application claims priority from U.S. Provisional patent application Ser. No. 63/175,596 by ANTON Shakirov entitled A METHOD AND APPARATUS FOR A SUBMERSIBLE MULTISTAGE LABYRINTH-SCREW PUMP filed on Apr. 16, 2021, which is hereby incorporated by reference herein in its entirety. This patent application also claims priority from U.S. Provisional patent application Ser. No. 63/298,734 by ANTON Shakirov entitled A METHOD AND APPARATUS FOR A SUBMERSIBLE MULTISTAGE LABYRINTH-SCREW PUMP filed on Jan. 12, 2022, which is hereby incorporated by reference herein in its entirety; this patent application also claims priority from U.S. Provisional patent application Ser. No. 63/283,340 by ANTON Shakirov entitled Submersible Oil-filled Permanent Magnet Electric Motor, filed on 26 Nov. 2021, which is hereby incorporated by reference herein in its entirety; this patent application also claims priority from U.S. Provisional patent application Ser. No. 63/283,342 by ANTON Shakirov entitled Axial Support Shoe Unit of Oil-Filled Submersible Motor filed on 26 Nov. 2021, which is hereby incorporated by reference herein in its entirety; and this patent application claims priority from U.S. Provisional patent application Ser. No. 63/283,343 by ANTON Shakirov entitled Submersible Pump Unit Drive with Heat Exchanger filed on 26 Nov. 2021, which is hereby incorporated by reference herein in its entirety.

BACKGROUND OF THE INVENTION

Submersible pumps are in wide use in the petrochemical recovery operations worldwide.

FIELD OF THE INVENTION

The present invention is in the field of petroleum engineering specifically to multistage labyrinth-screw pumps with a floating assembly of screw rotors.

UK Patent GB2377972A, published Jan. 29, 2003, which is hereby incorporated by reference in its entirety, discloses a submersible borehole centrifugal pump containing a constructive solution to provide lubrication and stabilize the operation of the pump shaft supports. The pump consists of a shaft with an axial through channel, radial bearings surrounding the shaft, a set of pump stages. The through axial channel of the shaft has an inlet for a liquid made on the lower end of the shaft and outlet openings on the side surface of the shaft, which provide liquid outlet directly into the gap between the inner surface of the outer annular element of the radial bearing and the shaft.

A set of stages (with impellers and guide vanes) is used to increase the pressure of the fluid to ensure its passage through the through axial channel of the shaft to the radial bearings (see FIG. 2 to patent GB 2377972 A). The presence of fluid provides the necessary lubrication regime to extend the service life of radial thrust bearings. However, solid mechanical particles can penetrate into the through axial bore of the shaft, which enter the above clearance and can damage the radial bearing. Moreover, such a constructive technical solution for extending the service life of the pump bearings cannot be used for axial (non-radial) bearings of a submersible borehole centrifugal pump.

UK Patent GB2377972A, published Jan. 29, 2003, which is hereby incorporated by reference in its entirety, discloses a submersible borehole centrifugal pump containing a constructive solution to provide lubrication and stabilize the operation of the pump shaft supports. The pump consists of a shaft with an axial through channel, radial bearings surrounding the shaft, a set of pump stages. The through axial channel of the shaft has an inlet for a liquid made on the lower end of the shaft and outlet openings on the side surface of the shaft, which provide liquid outlet directly into the gap between the inner surface of the outer annular element of the radial bearing and the shaft. A set of stages (with impellers and guide vanes) is used to increase the pressure of the fluid to ensure its passage through the through axial channel of the shaft to the radial bearings (see FIG. 2 to patent GB 2377972 A). The presence of fluid provides the necessary lubrication regime to extend the service life of radial thrust bearings. However, solid mechanical particles can penetrate into the through axial bore of the shaft, which enter the above clearance and can damage the radial bearing. Moreover, such a constructive technical solution for extending the service life of the pump bearings cannot be used for axial (non-radial) bearings of a submersible borehole centrifugal pump.

Patent RU 2726977, published on Jul. 17, 2020, which is hereby incorporated by reference in its entirety, discloses a submersible multistage borehole centrifugal pump with a compression assembly scheme and a cylindrical casing. It has a shaft, a fishing head, an inlet module with a chamber with holes for taking well fluid. The set of pump is located between the fishing head and the chamber with holes for intake of well fluid and contains impellers and guide vanes assembled on a shaft and mounted along the axis of the cylindrical body. The pump is equipped with a hydrostatic shaft support located below the chamber with holes for intake of well fluid. Such a hydrostatic support can act as an unloading support for the main—lower axial support for pumps with a lower axial support located in the hydraulic protection of the motor (below the inlet module of the pump assembly). The hydrostatic support contains a thrust disk rigidly fixed in the housing of the input module, as well as an axial support disk rigidly fixed to the shaft, located below the thrust disk. The axial support disk is made with the possibility of mating it through the end stops (on the mating surfaces) with the thrust disk during vertical movement of the axial support disk. The hydrostatic bearing also includes a pressure chamber formed below the axial bearing disc. The channels in the wall of the fishing head and in the wall of the injection chamber of the inlet module are connected by an injection channel in the form of a separate pipeline running along the outer cylindrical surface of the pump (see FIG. 1 to RF patent RU 2726977). The injection channel is configured to supply a portion of the high—pressure wellbore fluid to the injection chamber. This technical solution has a number of design drawbacks that do not allow to significantly increase the pump resource by increasing the service life of the axial supports. In particular, the external design of the injection channel increases the likelihood of its damage during operation and installation in a well, increases the mass of the pump, complicates the design of the pump and its assembly. In addition, in such a design, the probability of penetration of solid particles of impurities of the well fluid from the chamber of the fishing head through the pipeline into the injection chamber increases and, accordingly, leads to failure of the hydrostatic support when it becomes clogged and an increase in undesirable contact pressures in the tribo-couplings of the contact support after a relatively short time period.

RU202692U1, published on Mar. 3, 2021, which is hereby incorporated by reference in its entirety, discloses a multistage centrifugal pumps with a compression assembly scheme, in particular, to high-speed borehole pumps (mainly with valve drive) with a lower axial support located in the hydraulic protection of the engine (below the inlet module of the pump.

Patent RU 2726977, published on Jul. 17, 2020, which is hereby incorporated by reference in its entirety, discloses a submersible multistage borehole centrifugal pump with a compression assembly scheme and a cylindrical casing. It has a shaft, a fishing head, an inlet module with a chamber with holes for taking well fluid. The set of pump is located between the fishing head and the chamber with holes for intake of well fluid and contains impellers and guide vanes assembled on a shaft and mounted along the axis of the cylindrical body. The pump is equipped with a hydrostatic shaft support located below the chamber with holes for intake of well fluid. Such a hydrostatic support can act as an unloading support for the main—lower axial support for pumps with a lower axial support located in the hydraulic protection of the motor (below the inlet module of the pump assembly). The hydrostatic support contains a thrust disk rigidly fixed in the housing of the input module, as well as an axial support disk rigidly fixed to the shaft, located below the thrust disk. The axial support disk is made with the possibility of mating it through the end stops (on the mating surfaces) with the thrust disk during vertical movement of the axial support disk. The hydrostatic bearing also includes a pressure chamber formed below the axial bearing disc. The channels in the wall of the fishing head and in the wall of the injection chamber of the inlet module are connected by an injection channel in the form of a separate pipeline running along the outer cylindrical surface of the pump (see FIG. 1 to RF patent RU 2726977). The injection channel is configured to supply a portion of the high-pressure wellbore fluid to the injection chamber. This technical solution has a number of design drawbacks that do not allow to significantly increase the pump resource by increasing the service life of the axial supports. In particular, the external design of the injection channel increases the likelihood of its damage during operation and installation in a well, increases the mass of the pump, complicates the design of the pump and its assembly.

SUMMARY OF THE INVENTION

A method and apparatus to increase the labyrinth screw pump life, achieved by a decrease in axial forces in thrust tribo-couplings by creating a chamber into which high pressure at the exit from the stage is transmitted through the additional channels of the rotor, thereby creating an opposite axial force, which reduces the contact pressure on the friction surface of the thrust bearing.

BRIEF DESCRIPTION OF THE DRAWINGS

The drawings are drawn to scale.

DETAILED DESCRIPTION OF THE INVENTION

Figure 1:
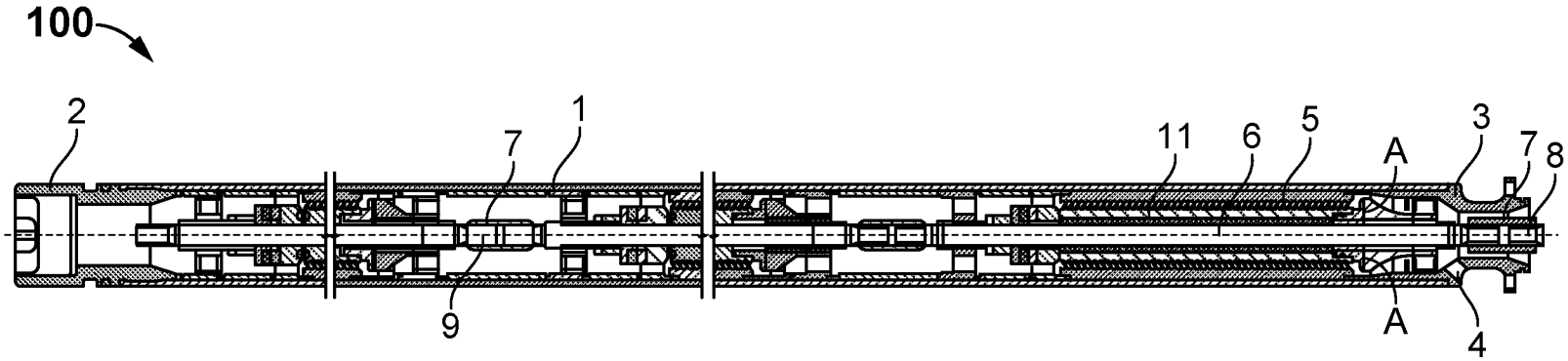
FIG. 1—shows a schematic depiction of a cross sectional side view of a multistage labyrinth screw pump and its main components in a particular illustrative embodiment of the invention.

A particular illustrative embodiment of a method and apparatus for a submersible multistage labyrinth-screw pump is disclosed. The present invention relates to petroleum engineering specifically to multistage labyrinth screw pumps with floating assembly of screw rotors.

Prior submersible multistage labyrinth screw pumps, which respectively contain a cylindrical housing, at the ends of which a discharge head and an intake module with holes for produced fluid are installed; a set of stages consisting of a rotor with a screw thread and stator, which also has a screw thread with an opposite direction relative to rotor cutting, which are assembled on a shaft mounted in bearings along the axis of the housing. When the pump is operating, the pump section shaft, which is rotating the rotor with a screw thread is kept from radial forces by radial bearings, which consist of protective bushings on the shaft and bearing shells.

The rotor, which has a screw thread, provides a dynamic movement of the liquid in the cavities towards the pump discharge head (liquid exit), ensures the swirling of the liquid flow in the cavities of the stator thread, thereby increasing its kinetic energy and increasing the pump head. At high pressure drops at the pump stage (rotor-stator) of the labyrinth screw pump, significant axial loads arise that act on the rotor and the stage shaft. This is one of the main reasons for their intensive wear, which reduces the run life of the pump.

In contrast, in a particular illustrative embodiment of the invention, the method and apparatus increase the labyrinth screw pump life, achieved by 1) a decrease in axial forces in thrust tribo-couplings by creating a chamber into which high pressure at the exit from the stage is transmitted through the additional channels of the rotor, thereby creating an opposite axial force, which reduces the contact pressure on the friction surface of the thrust bearing and 2) a rotor having an external surface shape and a stator having an internal surface shape wherein rotor external surface shape and a stator internal surface shape have rounded shapes without rectangular edges to obtain high speed performance with reduced vortices.

A particular illustrative embodiment of the invention relates to petroleum engineering, namely to multistage centrifugal pumps with a compression assembly scheme. In a particular illustrative embodiment of the invention, a submersible multistage centrifugal pump contains a vertical cylindrical casing, at the ends of which a fishing head and an inlet module with holes for intake of borehole fluid are installed, a set of stages consisting of impellers and guide vanes assembled on a shaft mounted along the axis of the casing. The pump is equipped with a hydrostatic support unit located inside the inlet module. It includes a thrust disk rigidly fixed to the input module housing, an axial support disk located under it, rigidly fixed to the shaft. The hydrostatic support also contains a pressure chamber formed below the axial support disk, while the above pump has a delivery channel, configured to supply part of the well fluid to the injection chamber. The delivery channel is made in the form of an internal axial shaft channel with at least one inlet made above the set of steps and with at least one outlet opening into the inner cavity of the delivery chamber. The technical result of a particular illustrative embodiment of invention the is an increase in the service life of the pump.

In a particular illustrative embodiment of the invention, a multistage centrifugal pump is disclosed having a compression assembly scheme, in particular, to high-speed borehole pumps (mainly with valve drive) with a lower axial support located in the hydraulic protection of the engine (below the inlet module of the pump. A particular embodiment of the present invention relates to petroleum engineering, namely to multistage centrifugal pumps with a compression assembly scheme, in particular, to high-speed borehole pumps (mainly with valve drive) with a lower axial support located in the hydraulic protection of the engine (below the inlet module of the pump assembly).

The working bearing elements of prior known pumps (both radial and axial bearings) are usually subject to severe overheating due to high contact friction and are subject to high mechanical stress. Such effects are one of the reasons for their rapid wear and tear and, accordingly, a decrease in the working life of the pumping unit, especially for high. The working bearing elements of the above pumps (both radial and axial bearings) are usually subject to severe overheating due to high contact friction and are subject to high mechanical stress. Such effects are one of the reasons for their rapid wear and tear and, accordingly, a decrease in the working life of the pumping unit, especially for high-speed pumps. To prevent the above undesirable effects, various design solutions are used to increase the reliability of the pump support elements.

The essence of a particular embodiment of the present invention is disclosed. The objective of the present invention is to develop a constructive solution that increases the reliability of the pump (in particular, high-speed pumps with shaft revolutions of more than 3000 rpm) while simplifying the design of the pump and reducing its weight and dimensions. It is necessary to provide an increase in the working life of a submersible multistage borehole centrifugal pump with a compression pump assembly scheme (in particular for pumps with a lower axial support located in the engine hydraulic protection section and an additional hydrostatic unloading axial.

In a particular embodiment of the present invention is an increase in the pump resource is ensured by a long and stable decrease in the contact pressure in the tribo-conjugated zones of the axial support elements of the sliding submersible multistage centrifugal pump during pump operation by efficient (long-term and magnitude) unloading of the rotating shaft from axial loads with pressure drops at the inlet into the pump and the formation fluid outlet from it. In this case, the axial loads are concentrated on the pump shaft. Long-term and stable decrease in contact pressure in tribo-coupled supports, in particular, is due to the fact that the structure of the hydrostatic support reduces the likelihood of damage to its working elements (discharge channel and support chamber). An additional advantage of this pump is its increased productivity due to the possibility of increasing the lifting capacity of its axial. The technical result of a particular embodiment of the present invention is an increase in the pump resource is ensured by a long and stable decrease in the contact pressure in the tribo-conjugated zones of the axial support elements of the sliding submersible multistage centrifugal pump during pump operation by efficient (long-term and magnitude) unloading of the rotating shaft from axial loads with pressure drops at the inlet into the pump and the formation fluid outlet from it. In this case, the axial loads are concentrated on the pump shaft. Long-term and stable decrease in contact pressure in tribo-coupled supports, in particular, is due to the fact that the structure of the hydrostatic support reduces the likelihood of damage to its working elements (discharge channel and support chamber).

In a particular illustrative embodiment of the invention, a submersible multistage borehole centrifugal pump with a compression assembly scheme and with a cylindrical casing is disclosed, containing a shaft, a fishing head, an inlet module with a chamber with holes for sampling well fluid, a set of stages located between the fishing head and a chamber with holes for sampling well liquid and containing impellers and guide vanes, assembled on the shaft and installed along the axis of the cylindrical body. The pump is equipped with a hydrostatic support located below the chamber with holes for intake of well fluid. The hydrostatic support contains a thrust disk rigidly fixed in the housing of the input module, as well as an axial support disk rigidly fixed to the shaft, located below the thrust disk. The axial support disk is configured to mate with the thrust disk during vertical movement of the axial support disk, while the hydrostatic support comprises a discharge chamber formed below the axial support disk. The pump has an injection channel configured to supply a portion of the well fluid to the injection chamber. The delivery channel is designed as an inner axial shaft channel with at least one inlet opening above the set of steps and with at least one outlet opening into the inner cavity of the delivery chamber. These holes are made in the form of radial channels located on the lateral surface of the shaft, while the upper and lower end ends of the shaft. To achieve the stated technical results, a submersible multistage borehole centrifugal pump with a compression assembly scheme and with a cylindrical casing has been developed, containing a shaft, a fishing head, an inlet module with a chamber with holes for sampling well fluid, a set of stages located between the fishing head and a chamber with holes for sampling well liquid and containing impellers and guide vanes, assembled on the shaft and installed along the axis of the cylindrical body. The pump is equipped with a hydrostatic support located below the chamber with holes for intake of well fluid. The hydrostatic support contains a thrust disk rigidly fixed in the housing of the input module, as well as an axial support disk rigidly fixed to the shaft, located below the thrust disk. The axial support disk is configured to mate with the thrust disk during vertical movement of the axial support disk, while the hydrostatic support comprises a discharge chamber formed below the axial support disk. The pump has an injection channel configured to supply a portion of the well fluid to the injection chamber. The delivery channel is designed as an inner axial shaft channel with at least one inlet opening above the set of steps and with at least one outlet opening into the inner cavity of the delivery chamber. These holes are made in the form of radial channels located on the lateral surface of the shaft, while the upper and lower end ends of the shaft are made blind. The pump has an injection channel configured to supply a portion of the well fluid to the injection chamber. The delivery channel is designed as an inner axial shaft channel with at least one inlet opening above the set of steps and with at least one outlet opening into the inner cavity of the delivery chamber. These holes are made in the form of radial channels located on the lateral surface of the shaft, while the upper and lower end ends of the shaft are made blind. The pump has an injection channel configured to supply a portion of the well fluid to the injection chamber. The delivery channel is designed as an inner axial shaft channel with at least one inlet opening above the set of steps and with at least one outlet opening into the inner cavity of the delivery chamber. These holes are made in the form of radial channels located on the lateral surface of the shaft, while the upper and lower end ends of the shaft are made blind.

The inlet and outlet openings of the inner axial channel have diameters from 1.5 to 3.5 mm, the inner axial channel of the shaft with a diameter of 5 to 8 mm, and the diameter of the shaft. The inlet and outlet openings of the inner axial channel can have diameters from 1.5 to 3.5 mm, the inner axial channel of the shaft with a diameter of 5 to 8 mm, and the diameter of the shaft D is not less than 12 mm and not more than 30 mm.

The axial support disk can be made in the form of a sleeve having a lower part with a recess forming the upper part of the pressure chamber, while at least one of the above-mentioned outlet opens into the cavity of the upper part of the pressure chamber. The recess has an annular shape with a depth of at least 0.2 D and an outer diameter of at least 1.5 D, while the shaft diameter D is not less than 18 mm and not more than 30 mm. In the lower part of the discharge chamber, a labyrinth-screw type seal with a rotor located on the pump shaft can be made. The diameter of the axial support disc can be at least 10% larger than the rotor diameter of the labyrinth-screw type seal. The axial support disk can be made in the form of a sleeve having a lower part with a recess forming the upper part of the pressure chamber, while at least one of the above-mentioned outlet opens into the cavity of the upper part of the pressure chamber. The recess may have an annular shape with a depth of at least 0.2 D and an outer diameter of at least 1.5 D, while the shaft diameter D is not less than 18 mm and not more than 30 mm. In the lower part of the discharge chamber, a labyrinth-screw type seal with a rotor located on the pump shaft can be made. The diameter of the axial support disc can be at least 10% larger than the rotor diameter of the labyrinth-screw type seal.

FIG. 1 shows a schematic representation of a particular illustrative embodiment of the invention in which a submersible multistage borehole centrifugal pump with a compression assembly scheme (a section of the motor (valve drive) with hydraulic protection with a lower axial. FIG. 1 shows a submersible multistage borehole centrifugal pump with a compression assembly scheme (a section of the motor (valve drive) with hydraulic protection with a lower axial support is not shown).

The force on the lower axial support is transmitted through the shaft, which can be made up of several parts. In this case, a constant automatic balance of the previously indicated forces is ensured, since they both depend on the operating mode of the pump, characterized by the shaft rotation frequency and the flow rate of the formation fluid.

As a result of the operation of the hydrostatic support, a long and stable decrease in the contact pressure in the tribo-conjugated zones of the axial support elements of sliding of the submersible multistage centrifugal pump is provided by unloading the rotating shaft from axial loads at pressure drops at the inlet to the pump and the outlet of formation fluid from it. Thus, the long service life of the hydrostatic support provides a correspondingly long period of effective operation (with reduced contact pressure) of the tribological couplings of the lower axial support (hydraulic protection) and, accordingly, an increase in the service life of the pump. As a result of the operation of the hydrostatic support, a long and stable decrease in the contact pressure in the tribo-conjugated zones of the axial support elements of sliding of the submersible multistage centrifugal pump is provided by unloading the rotating shaft from axial loads at pressure drops at the inlet to the pump and the outlet of formation fluid from it. Thus, the long service life of the hydrostatic support provides a correspondingly long period of effective operation (with reduced contact pressure) of the tribological couplings of the lower axial support (hydraulic protection) and, accordingly, an increase in the service life of the pump as a whole. The specified pump. The specified pump can be manufactured industrially.

In a particular illustrative embodiment of the invention, the increase the labyrinth screw pump life, achieved by a decrease in axial forces in thrust tribo-couplings by creating a chamber into which high pressure at the exit from the stage is transmitted through the additional channels of the rotor, thereby creating an opposite axial force, which reduces the contact pressure on the friction surface of the thrust bearing is achieved by the present invention fact that a submersible multistage labyrinth screw pump contains a cylindrical housing, at the ends of which a discharge head and an intake module with holes for produced fluid are installed; a set of stages consisting of a rotor with a screw thread, fixed on the shaft and a stator, fixed in the housing. The stage shaft rotates in radial bearings installed in the housing, while the rotor has a thrust bearing consisting of a pivot, which is connected to the rotor. And a thrust runner, which is fixed on the stationary housing of the radial bearing from the side of the fluid inlet into the stage. The contact surfaces of the thrust bearing of the rotor are formed in such a way that its contact surfaces are at the maximum possible radius of the pivot and thrust runner, and its central part has a gap that forms a cavity connected by rotor channels, along which the pressure is equalized between the high and low sides of the stage.

As mentioned above, an increase in the pump's life occurs due to a decrease in the contact pressure in the tribo-coupling of labyrinth screw pump rotor thrust bearings, by unloading the rotating shaft from axial loads at pressure drops at the inlet and the outlet of the stage. In this case, all types of axial loads are concentrated on the pump shaft. Compensation or reduction of the resultant thrust vector in the pump is carried out only by applying the opposite force vector directly to the shaft.

Turning now to FIG. 1, FIG. 1 shows a schematic depiction of a cross sectional side view of a multistage labyrinth screw pump and its main components in a particular illustrative embodiment of the invention. As shown in FIG. 1, in a particular illustrative embodiment of the invention 100 a submersible multistage labyrinth screw pump, contains a cylindrical housing 1, at the ends of which a discharge head 2 is installed, mating with a tubing string (not shown in the drawing) and an intake module 3 with holes 4 for produced fluid, a set of module stages, consisting of a rotor 11 and a stator 5, with counter-directional screw threads, assembled on a shaft 6, connected by means of a coupling 7 to a drive shaft 8 or to a shaft of an adjacent stage 9. Each pump stage is equipped with two radial bearings 10, in which the shaft 6 of the rotor 11 rotates.

Figure 2:
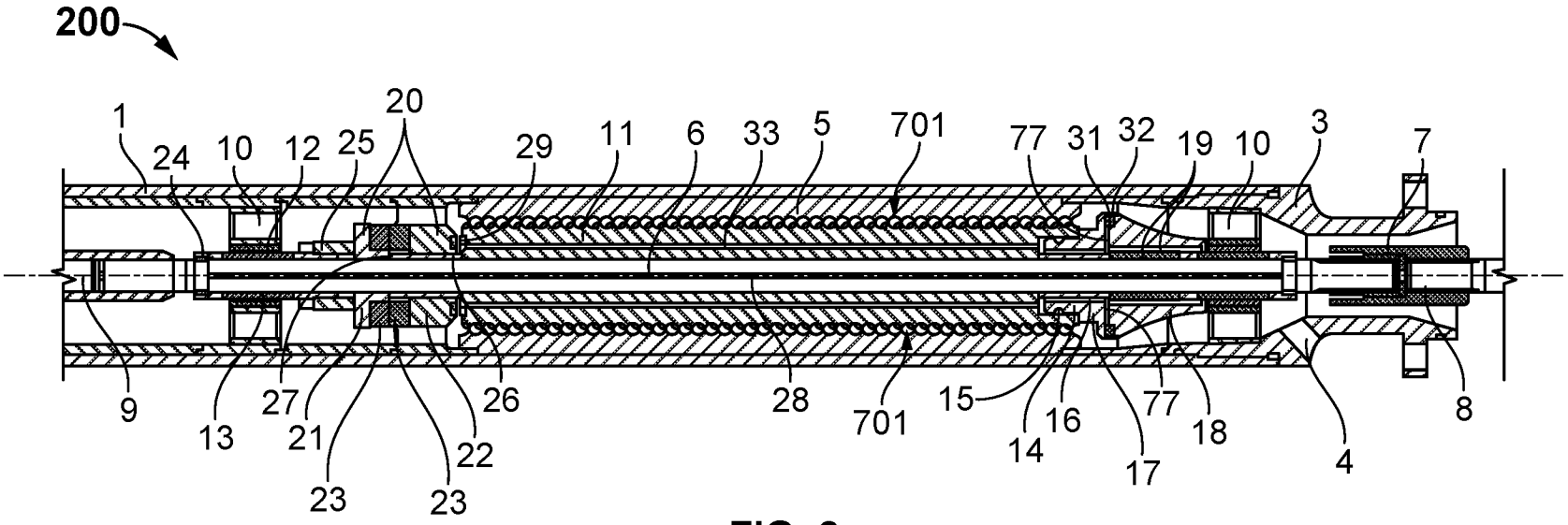
FIG. 2—shows a schematic depiction of a cross sectional side view of a stage in a multistage labyrinth screw pump and its main components in a particular illustrative embodiment of the invention.

Turning now to FIG. 2, FIG. 2 shows a schematic depiction of a cross sectional side view of a stage in a multistage labyrinth screw pump and its main components in a particular illustrative embodiment of the invention. As shown in FIG. 2, in a particular illustrative embodiment of the invention 200 the mating of the shaft 6 with the liners 12 of the radial bearing 10 is provided by means of the protective shaft sleeves 13. The rotor 11 in its right side is equipped with a thrust bearing 14, which is axially inserted into the body of the rotor 11 with a cylindrical mating seal with rings 15. The pivot 21 has holes 16 that connect cavity 77 of the thrust bearing 17 of the rotor 11. The thrust bearing 17 has a thrust runner 18, which includes a groove seal. The stage of the labyrinth screw pump is additionally equipped with a thrust bearing 20 of the shaft 6, which consists of a pivot 21 and a stationary thrust runner 22, equipped with wear-resistant shells/sintered rings 23.

Shaft 6 of stage 5 has two embedded supports 24, which provide by means of a threaded spacer 25 axial fastening on a rotating shaft 6 of a set of parts, including protective bushings, spacer bushing 26, rotor 11, thrust runner 18, groove seal sleeve 19. In the general set of rotating with the shaft 6 parts there are several adjusting rings 27, by means of which the dimensional chain of the stage and the clearance in the thrust bearing 20 is adjusted. Rotation to all parts mated with the shaft 6 is transmitted by the key 28. The left end of the rotor 11 is equipped with a wear-resistant anti-friction safety ring 29 interacting with the wear ring of the end of the thrust bearing 20. The unloading thrust bearing 17 has a tribo-coupling consisting of an anti-friction rotating ring 31 and a hardened layer 32 (shown in FIG. 5) center bearing housing 18. To equalize the pressure at the ends of the rotor 11, it has several through symmetrical holes located along its axis.

When the shaft 6 of the labyrinth screw pump rotates, the liquid enters the pump through hole 4 of the intake module 3 into the receiving zone of stage 5 of the multistage pump and enters the inlet of the first rotor 11. Further, the liquid flow is compressed from stage to stage, reaching a maximum value in the discharge head 2. In this case, an axial force directed against the flow of the liquid arises on the shaft 6 of the stage, the magnitude of which is determined by the pressure drop at the ends of the shaft and the ends of the pump stage rotor.

Counteraction to the total axial force on the pump shaft 6 is ensured by transferring through the holes 33 of the high-pressure rotor from the left rotor zone to the right zone, specifically to the cavity 77 of the unloading thrust bearing 17 of the stage 5. In this case, the reactive force on the thrust bearing 17 reduces the total axial force by an amount corresponding to the ratio of the transverse area of the cavity 77 to the transverse area of the rotor end. By technology construction means it is possible to achieve a reduction in the total axial force by 70-85%.

For smooth running-in of both thrust bearings (17 and 20) while maintaining the tightness of cavity 77, the tribo-coupling of the thrust bearing 17 is created quickly by using an antifriction composite material of the ring 31 of the thrust runner 14. After running-in of two thrust bearings 17 and 20, when the residual axial load in the rotor is distributed between them proportionally, the durability of this friction mode will be ensured by the high wear resistance of the tribo-coupling of the thrust bearing 20 due to the use of sintered rings 23 of the thrust runner and thrust bearing.

Figure 3:
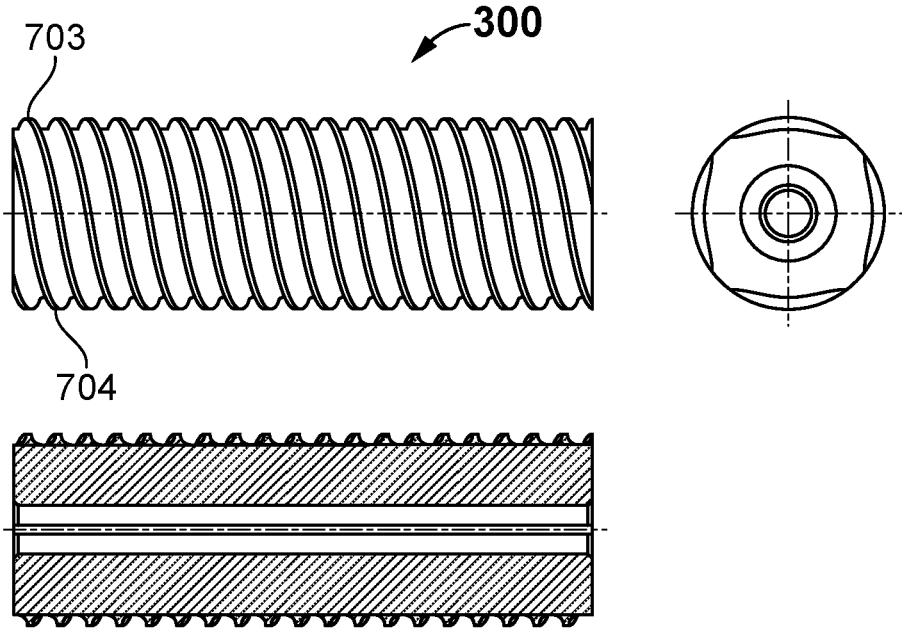
FIG. 3—shows a side view of a rotor with a multi-threaded screw in a particular illustrative embodiment of the invention.
Figure 4:
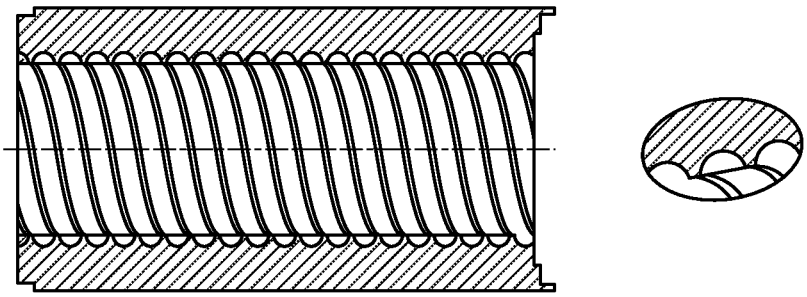
FIG. 4—shows a side view of a stator with an opposite thread in a particular illustrative embodiment of the invention.
Figure 5:
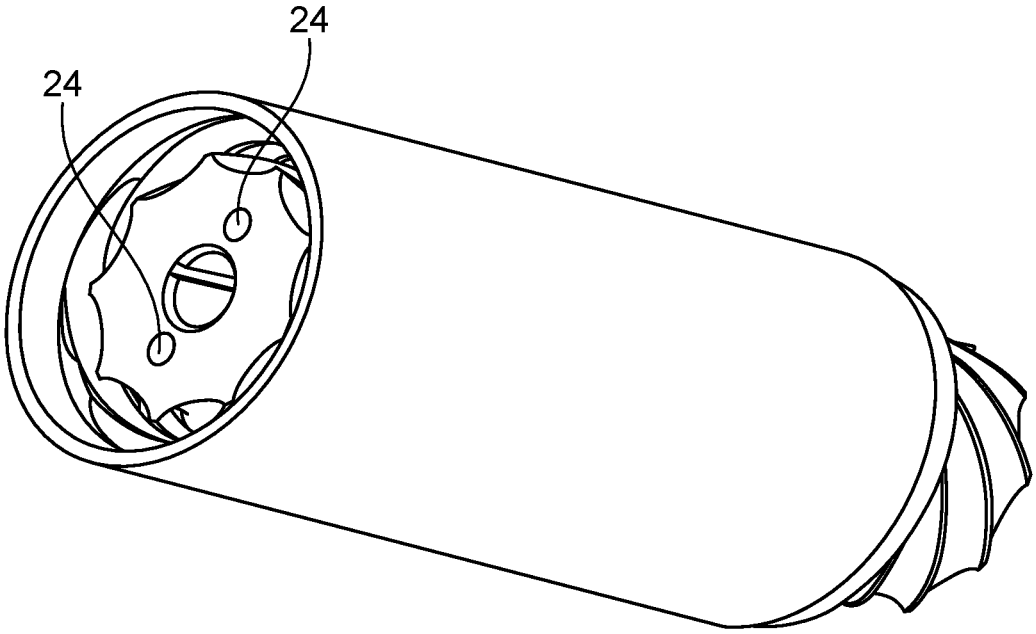
FIG. 5—shows a side view labyrinth-screw pair with opposite multi-threads in a particular illustrative embodiment of the invention.
Figure 6:
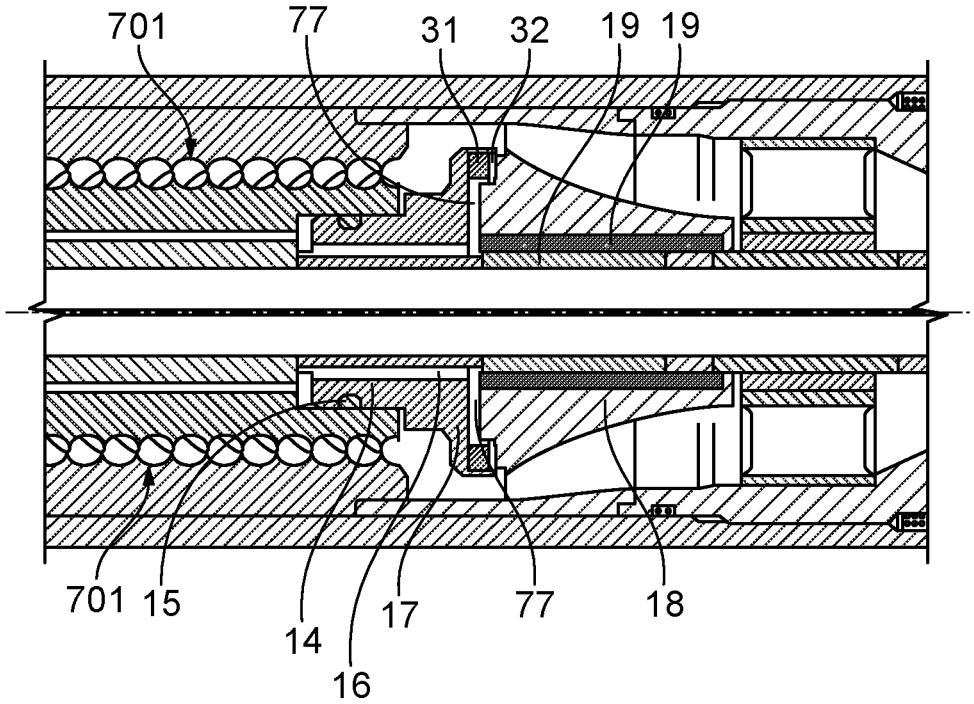
FIG. 6—shows a side view of a cross section thrust unloading bearing of the rotor with the cavity in a particular illustrative embodiment of the invention.
Figure 7:
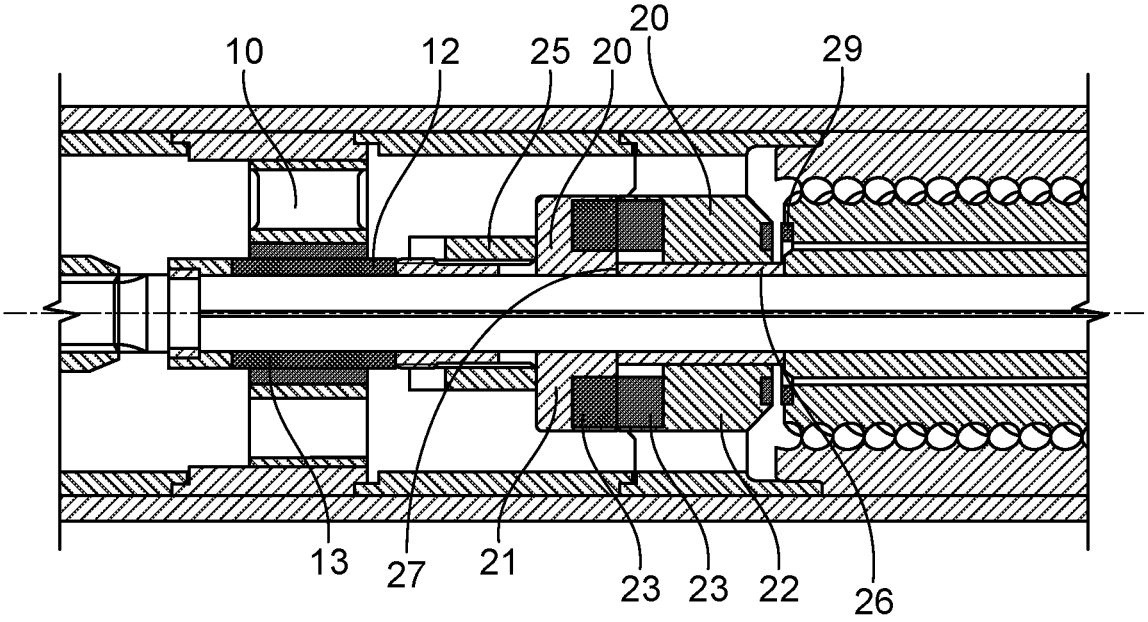
FIG. 7—shows a side view cross section of a carrying thrust bearing of the rotor in a particular illustrative embodiment of the invention.

FIG. 3 shows a side view of a rotor with a multi-threaded screw in a particular illustrative embodiment of the invention. FIG. 4—shows a side view of a stator with an opposite thread in a particular illustrative embodiment of the invention. FIG. 5—shows a side view labyrinth-screw pair with opposite multi-threads in a particular illustrative embodiment of the invention. FIG. 6—shows a side view of a cross section thrust unloading bearing of the rotor with the cavity 77 in a particular illustrative embodiment of the invention. FIG. 7—shows a side view cross section of a carrying thrust bearing of the rotor in a particular illustrative embodiment of the invention.

Prior art, as shown in U.S. Pat. No. 9,382,800 B2 (the '800 patent) disclosing a pump assembly comprising a stator and a rotor having vanes of opposite handed thread arrangements is described. A radial gap is located between the stator vanes and the rotor vanes such that rotation of the rotor causes the stator and rotor to co-operate to provide a system for moving fluid longitudinally between them. specifying radial gap range of 1.28-10 mm cannot be applied to an illustrative embodiment of the invention, as the use of the 1.28-10 mm gap range specified in the '800 patent would significantly decrease pressure developed by an illustrative embodiment of the invention when operating with low-/medium-viscosity fluid.

Figure 8:
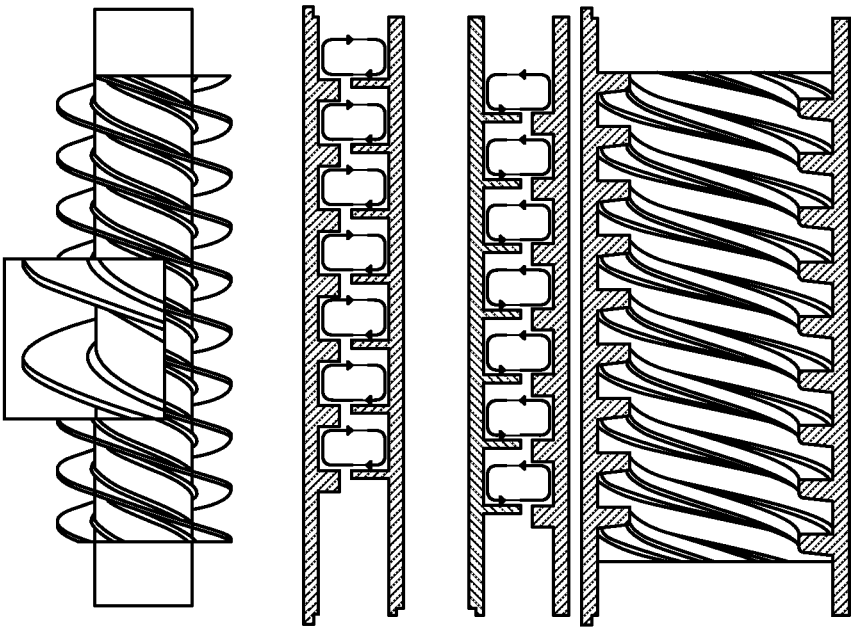
FIG. 8 depicts a prior art V pump.
Figure 9:
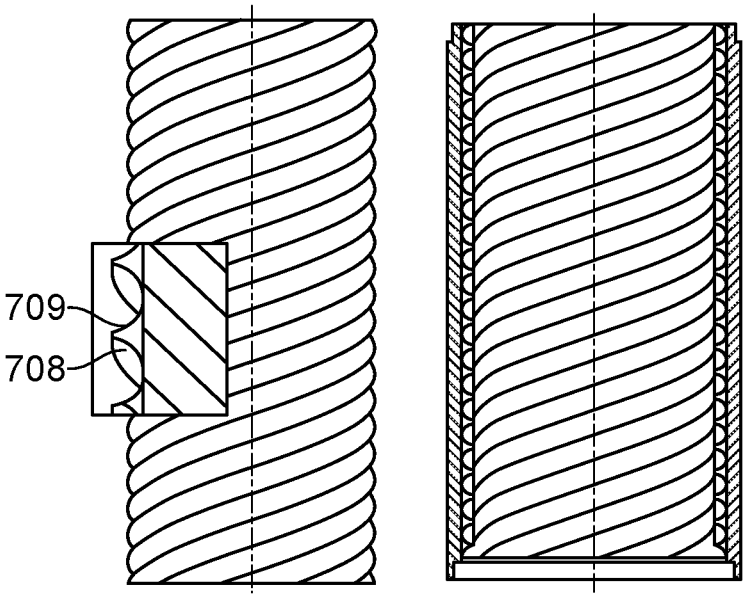
FIG. 9 depicts a schematic representation of a particular illustrative embodiment of the invention having a rotor having an external surface shape and a stator having an internal surface shape wherein rotor external surface shape and a stator internal surface shape have rounded shapes without rectangular edges to obtain high speed performance with reduced vortices.
Figure 10:
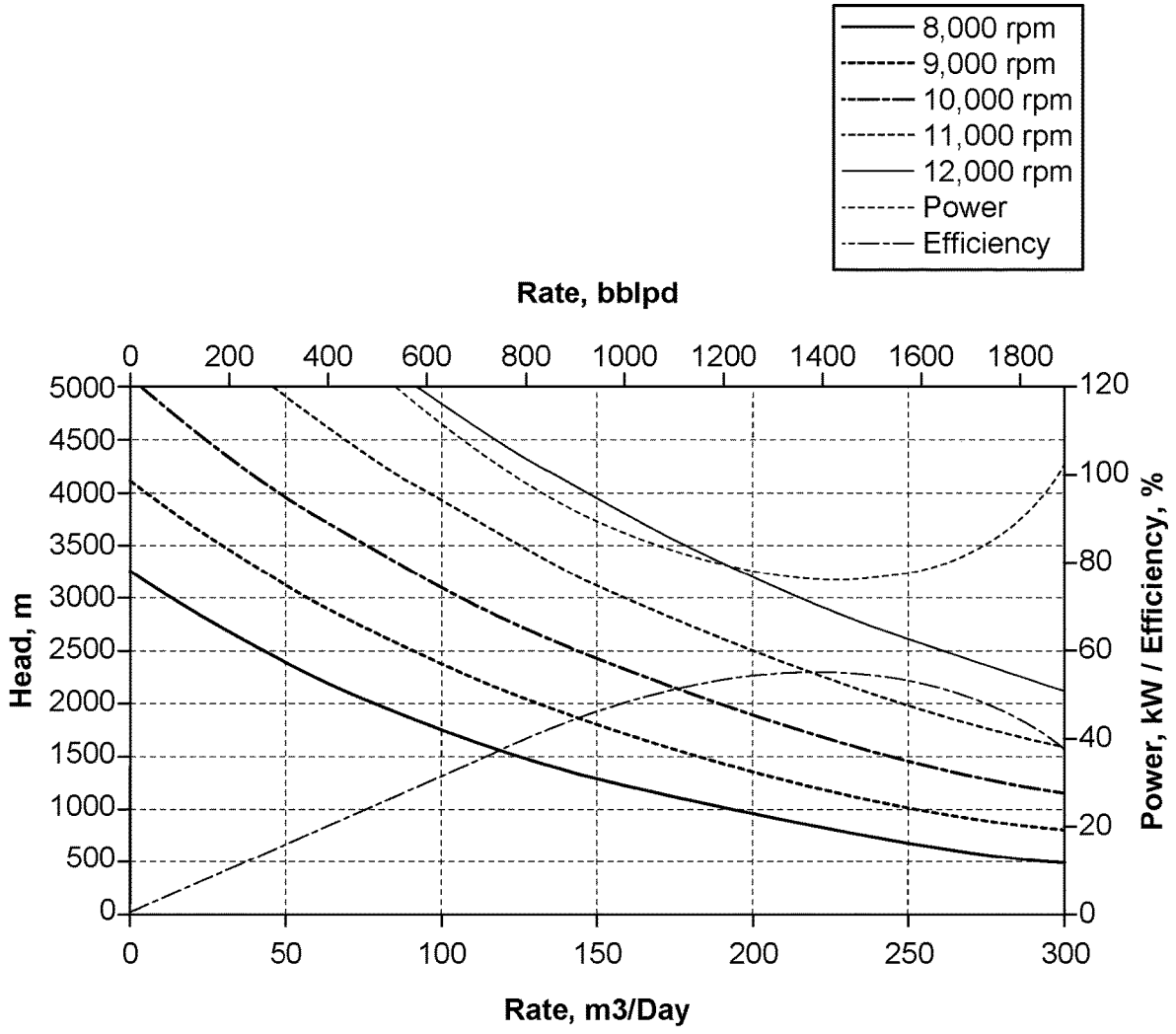
FIG. 10 depicts a performance curve for the rotor and stator shape of FIG. 9 having rounded shapes without rectangular edges are avoided to obtain high speed performance with reduced vortices.

Turning now to FIG. 8 and FIG. 9, in a particular illustrative embodiment of the invention comprises a specific design feature providing desired pump head, wherein a preferred radial gap is within 0.1-0.2 mm. This 0.1-0.2 mm gap provides desired pump performance not only for high-viscous fluids, but for the target low-viscous water/condensate/oil mixtures with gas. Due to high nameplate speeds and required high specific pressures, the resulting thrust load proportionally increases. Therefore, a thrust unloading module is provided as described herein. The thrust unloading module provides increased reliability and target run life over the prior art. The external surface of the rotor internal surface of the rotor as shown in FIG. 10 enables the 0.1-0.2 mm range gap to provide performance not only for high-viscous fluids, but for the target low-viscous water/condensate/oil mixtures with gas.

Additionally, a particular illustrative embodiment of the invention, pumps are designed to operate at ultra-high speeds of 10,000 rpm (up to 12,000 rpm as opposed to V-Pump shown in FIG. 8 preferred range of 500-4,800 rpm) which resulted in a number of design and material feature to tolerate the rotating speed. To achieve desired pump head, in a particular illustrative embodiment of the invention, the optimized thread shape shown in FIG. 9 avoids rectangular-shaped thread grooves and resulting unwanted vortices. In a particular illustrative embodiment, as shown in FIGS. 3, 6, 7, and 9 the stator channels 701 are semicircular in shape without rectangular surfaces and the rotor blades 703, 704 have a first curvilinear convex cross sectional portion 709 rising and a second curvilinear concave surface 708. The combination of the rotor blades have a convex 709/concave 708 cross sectional shape the semicircular stator channels 701 substantially reduce unwanted and harmful vortices that degrade the performance on a pump. In another particular embodiment of the invention, the rotor blades each have a flat portion parallel to a longitudinal axis of the rotor wherein a first convex portion is formed on the rotor blade, and a second concave portion that overlaps a flat portion of an adjacent rotor blade, wherein the first convex portion is overlapped by an adjacent rotor blade. In another particular embodiment of the invention the rotor blades forms a spiral pattern on an external surface of the rotor, the rotor blades each having a flat portion parallel to a longitudinal axis of the rotor, a first curvilinear convex portion extending radially outward on a first end of the first curvilinear convex portion from the flat portion and a second convex portion joined to a second end of the first convex curvilinear portion and radially downward toward the longitudinal axis of the rotor.

Experimental studies by many authors have established the maximum hydraulic efficiency of the working bodies of labyrinth screw pumps: with semicircular cutting up to 45%; with rectangular cutting no more than 36%. The average excess of the efficiency of semicircular cutting over the efficiency of rectangular cutting is 25%.

Figure 11:
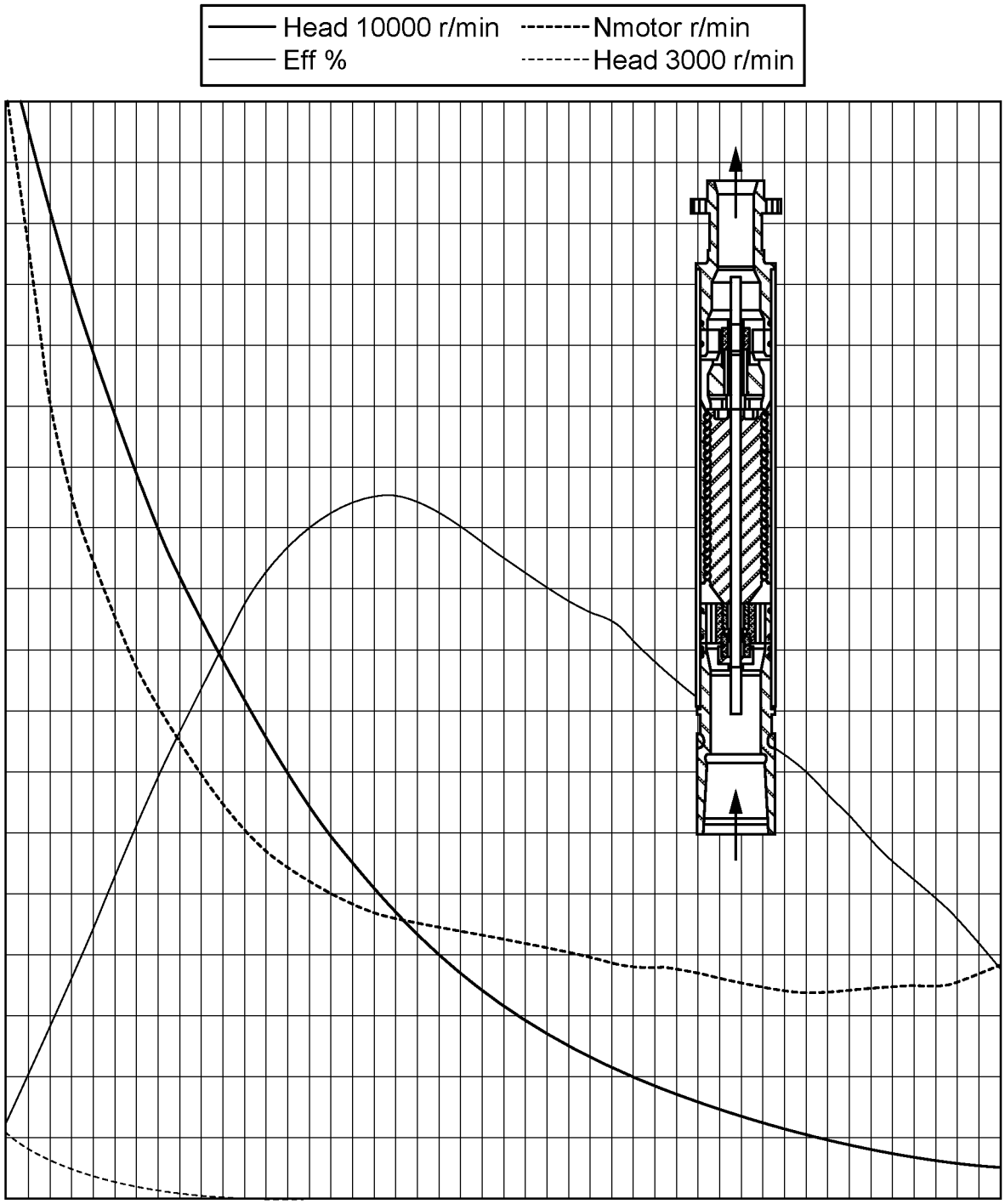
FIG. 11 is a performance curve for a particular illustrative embodiment of the invention as shown in FIG. 9.

FIG. 11 is a performance curve for a particular illustrative embodiment of the invention as shown in FIG. 9. The pressure dependence on the flow at any rotor speed has a constantly falling character, which contributes to the practical adaptation of the pump when used in technological processes with a variable operating mode.

It is important to note that the pump has an optimal zone of regimes in which the drop in efficiency is not very significant. The efficiency of the pump depends on many factors. Still, it is crucial to use methods of unloading from the axial force on the rotor and optimize the spacing of such units along the pump axis.

The main parameters of the matrix of the pressure-flow characteristic of a labyrinth-screw pump are estimated by recalculation formulas, subject to the geometric similarity of the thread, hydraulic resistance coefficients, and pressure:

$$Q_H = \frac{n_H D_H^3}{n_M D_M^3} Q_M;$$

$$H_H = \frac{n_H^2 D_H^2}{n_M^2 D_M^2} H_M;$$

$$N_H = \frac{n_H^3 D_H^5 \gamma_H}{n_M^3 D_M^5 \gamma_M} N_M.$$

Here:

$n_H$—new rotor speed;
$n_M$—frequency of rotation of the rotor of the experiment;
$Q_H$—main design pump flow;
$Q_M$—new design pump flow;
$H_H$—main design pump pressure;
$H_M$—new design pump pressure;
$N_H$—main design pump power (on shaft);
$N_M$—new design pump power (on shaft);
D—diameter of shaft In a particular illustrative embodiment of the invention, a design is disclosed of the apparatus and method wherein the device increases the reliability and durability of the submersible multistage labyrinth screw pump. A submersible multistage labyrinth screw pump contains a cylindrical housing, at the ends of which a discharge head and an intake module with holes for produced fluid are installed; a set of module stages consist of screw rotors and screw stators, which are attached to the shaft mounted along the axis of the housing. The construction approach is addressing the issue of increase the durability of the pump, so its module stage rotors are equipped with thrust- and unloading bearings, which perceive the total axial forces arising when the pump is running, while the unloading thrust bearing has a cavity into which high pressure is transmitted at the outlet of the rotor through symmetrical through channels of the rotor.

The submersible multistage labyrinth screw pump according to a particular embodiment, characterized in that, in order to evenly distribute the axial load between the thrust- and unloading bearings, the friction surface of the thrust runner ring of the unloading thrust bearing of the rotor is made of an antifriction composite material (such as graphite-fluoroplastic), which ensures quick running-in of the tribo-coupling. Submersible multistage labyrinth screw pump according to claim 1, characterized in that in order to ensure a high resource of the bearing thrust bearing, its friction surfaces are made of cermet materials (tungsten carbide-silicon carbide).

In a particular illustrative embodiment of the invention, an apparatus for a submersible screw pump is disclosed, the apparatus including but not limited to a cylindrical pump housing; a cylindrical stator with counter directional screw threads, wherein the cylindrical stator is rotationally fixed inside of the cylindrical housing; a cylindrical rotor inside of the cylindrical stator, wherein the cylindrical rotor has a screw thread with an opposite direction relating to the stator screw thread, wherein the rotor has an external surface shape and a stator having an internal surface shape wherein rotor external surface shape and the stator has an internal surface shape having rounded shapes without rectangular edges to obtain high speed performance with reduced vortices, wherein a gap between the internal surface of the stator and the external surface of the rotor is a range of 0.1-0.2 millimeters; a rotor shaft causes the rotor to spin; a discharge end of the cylindrical rotor configured with a hole to discharge production fluid; an intake end on the cylindrical pump housing configured with a hole to allow intake of production fluid to the cylindrical rotor, wherein the production fluid received at the spinning rotor wherein the rotor compresses the intake production fluid from an initial intake fluid pressure to a higher discharge fluid pressure, wherein the compression of the production fluid creates an axial force on the rotor shaft that is in opposition to the direction of fluid flow of production fluid from the intake end the rotor to the discharge end of the rotor; an intake thrust bearing attached to the rotor shaft on the intake end of the first modular pump stage; a discharge thrust bearing attached to the rotor shaft on the discharge end of the first modular pump stage; an unloading thrust bearing attached to the rotor shaft positioned between intake thrust bearing and the intake end of the rotor; a cavity in the unloading thrust bearing configured to receive production fluid from the discharge end of the rotor; and rotor fluid channels located inside of the rotor positioned substantially half way between the rotor shaft and an outside edge of the rotor, wherein the rotor fluid channels run between the discharge end of the rotor and the unloading thrust bearing cavity, wherein a counter action against axial force on the rotor shaft is provided by the production fluid in the rotor fluid channels from the discharge end of the rotor into the cavity in the unloading thrust bearing, wherein the production fluid in the cavity presses against the unloading thrust bearing thereby counteracting and reducing the axial force on the rotor shaft.

In another particular illustrative embodiment of the invention, the apparatus further including but not limited to a coupling attached to the rotor shaft; a second shaft attached to the rotor shaft by the coupling; an intake module on an intake end of the pump housing; holes on the intake module for introduction of produced fluid; and an intake module chamber inside the intake module. In another particular illustrative embodiment of the invention, wherein in the production fluid in the channels to equalizes pressures at the intake and discharge ends of the rotor. In another particular illustrative embodiment of the invention the apparatus further including but not limited to a pump section shaft attached to the cylindrical rotor shaft, wherein the pump section shaft spins and causes the rotor and rotor shaft to spin.

In another particular illustrative embodiment of the invention the apparatus further including but not limited to a plurality modular pump stages between the first end and the second end of the cylindrical housing, wherein a rotor shaft each stage in cylindrical housing attaches a shaft of an adjacent modular pump stage. In another particular illustrative embodiment of the invention, further including but not limited to a liner inside of the radial bearings wherein the liner is a protective shaft sleeve. In another particular illustrative embodiment of the invention wherein the thrust bearing is inserted into the body of the rotor with cylindrical intake rings. In another particular illustrative embodiment of the invention wherein the channels form holes in the discharge end of the rotor which are attached to the rotor channels that are symmetrical located along the axis of the rotor. In another particular illustrative embodiment of the invention the apparatus further including but not limited to: two radial bearings in which the rotor shaft rotates. In another particular illustrative embodiment of the invention wherein when the pump shaft rotates production fluid enters the intake module through a hole in the intake module of the multistage pump and enters the intake, wherein the fluid enters a first stage of the multistage pump and wherein the fluid is compressed from stage to stage reaching a maximum pressure at the discharge head.

In another particular illustrative embodiment of the invention a submersible multistage borehole centrifugal pump is disclosed with a compression assembly scheme and with a cylindrical casing, containing a shaft, a fishing head, an inlet module with a chamber with holes for intake of well fluid, a set of stages located between the fishing head and a chamber with holes for intake of well fluid and containing impellers and guide vanes assembled on the shaft and installed along the axis of the cylindrical body, while the pump is equipped with a hydrostatic support located below the chamber with holes for intake of well fluid, while the hydrostatic support contains a thrust disk rigidly fixed in the housing of the input module, and also rigidly fixed on the shaft, an axial support disk located below the thrust disk, while the axial support disk is configured to mate with the thrust disk during vertical movement of the axial support disk, while the hydrostatic support contains a discharge chamber formed below the axial support disk, where the above pump has an injection channel configured to supply part of the well fluid into the injection chamber, characterized in that the injection channel is made in the form of an internal axial shaft channel with an inlet above the set of stages and with an outlet opening into the inner cavity pressure chamber, and the above holes are made in the form of radial channels located on the lateral surface of the shaft, while the upper and lower end ends of the shaft are made blind, where the above pump has an injection channel configured to supply part of the well fluid into the injection chamber, characterized in that the injection channel is made in the form of an internal axial shaft channel with an inlet above the set of stages and with an outlet opening into the inner cavity pressure chamber, and the above holes are made in the form of radial channels located on the lateral surface of the shaft, while the upper and lower end ends of the shaft are made blind, where the above pump has an injection channel configured to supply part of the well fluid into the injection chamber, characterized in that the injection channel is made in the form of an internal axial shaft channel with an inlet above the set of stages and with an outlet opening into the inner cavity pressure chamber, and the above holes are made in the form of radial channels located on the lateral surface of the shaft, while the upper and lower end ends of the shaft are made blind, and the above holes are made in the form of radial channels located on the lateral surface of the shaft, while the upper and lower end ends of the shaft are made blind, and the above holes are made in the form of radial channels located on the lateral surface of the shaft, while the upper and lower end ends of the shaft are made blind.

In another particular illustrative embodiment of the invention the pump is characterized in that the inlet and outlet openings of the inner axial channel have diameters from 1.5 to 3.5 mm, the inner axial channel of the shaft has a diameter from 5 to 8 mm, and the diameter of the shaft D is not less than 12 mm, and no more than 30 mm. In another particular illustrative embodiment of the invention the pump is characterized in that a labyrinth-screw type seal with a rotor located on the pump shaft is made in the lower part of the discharge chamber. In another particular illustrative embodiment of the invention the pump is characterized in that the diameter of the axial support disk is at least 10% greater than the diameter of the rotor of the labyrinth-screw type seal.

The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. An apparatus for a submersible screw pump, the apparatus comprising:

a cylindrical pump housing;

a cylindrical stator having an internal surface that includes a screw thread, wherein the cylindrical stator is rotationally fixed inside of the cylindrical pump housing;

a cylindrical rotor disposed inside of the cylindrical stator, wherein the rotor has a screw thread and the screw thread of the rotor is formed in an opposite direction in relation to the screw thread of the stator, wherein the rotor has an external surface having a shape and the internal surface of the stator has rounded shapes without rectangular edges to obtain high speed performance of the apparatus with reduced vortices, wherein a gap between the internal surface of the stator and the external surface of the rotor is within a range of 0.1-0.2 millimeters;

a first rotor shaft causes the rotor to spin;

a discharge end of the rotor is configured with a hole to discharge production fluid;

an intake end on the pump housing is configured with a hole to allow intake of production fluid to flow into the spinning rotor, wherein the production fluid received into the spinning rotor is compressed by the spinning rotor starting at an initial intake fluid pressure and rising to a higher discharge fluid pressure, wherein the compression of the production fluid by the spinning rotor creates an axial force on the first rotor shaft that is opposite to the direction of fluid flow of the production fluid from the intake end of the rotor to the discharge end of the rotor;

a first thrust bearing attached to the first rotor shaft on the intake end of a first modular pump stage of the apparatus;

a discharge thrust bearing attached to the first rotor shaft on the discharge end of the first modular pump stage;

an unloading thrust bearing attached to the first rotor shaft positioned between the intake thrust bearing and the intake end of the rotor;

a cavity formed in the unloading thrust bearing that is configured to receive the production fluid from the discharge end of the rotor;

rotor fluid channels located inside of the rotor that are positioned substantially half way between the first rotor shaft and an outside edge of the rotor, wherein the rotor fluid channels are disposed between the discharge end of the rotor and the unloading thrust bearing cavity, wherein a counter action against axial force on the rotor shaft is provided by the production fluid in the rotor fluid channels flowing from the discharge end of the rotor into the cavity in the unloading thrust bearing, wherein the production fluid in the cavity presses against the unloading thrust bearing thereby counteracting and reducing the axial force on the rotor shaft; and wherein the exterior surface of the stator further comprises stator channels that include the rounded shapes without the rectangular edges and the rotor further includes rotor blades, wherein each of the rounded shapes of the stator channels comprises semicircular shape.

2. The apparatus of claim 1, wherein each rotor blade has a flat portion parallel to a longitudinal axis of the rotor, a first convex portion, and a second concave portion that overlaps a flat portion of an adjacent rotor blade, wherein the first convex portion is overlapped by an adjacent rotor blade, and the apparatus further comprises:

a coupling attached to the rotor shaft;

a second shaft attached to the rotor shaft by the coupling;

an intake module on an intake end of the pump housing;

holes formed on the intake module for introduction of the production fluid; and an intake module chamber disposed inside the intake module.

3. The apparatus of claim 2, wherein the submersible screw pump of the apparatus is a multistage pump and includes the first modular pump stage, and when the first pump shaft rotates the production fluid enters the intake module and the fluid is compressed in each stage of the multistage pump reaching a maximum pressure at a discharge head of the apparatus.

4. The apparatus of claim 1, wherein the rotor blades form a spiral pattern on the external surface of the rotor, each rotor blade has a flat portion parallel to a longitudinal axis of the rotor, a first curvilinear convex portion extending radially outward from a first end of the first curvilinear convex portion from the flat portion, and a second convex portion joined to a second end of the first convex curvilinear portion and extending radially downward toward the longitudinal axis of the rotor, wherein the production fluid disposed in the rotor fluid channels equalizes pressures at both the intake end and the discharge end of the rotor.

5. The apparatus of claim 1, wherein the apparatus further comprises:

a pump section shaft attached to the first rotor shaft, wherein when the pump section shaft spins the spinning pump section shaft further causes both the rotor and the first rotor shaft to spin.

6. The apparatus of claim 1, wherein the apparatus further comprises:

a plurality of modular pump stages that includes the first modular pump stage, the plurality of modular stages being positioned between a first end and a second end of the pump housing, and a rotor shaft is arranged in each modular pump stage of the plurality of modular pump stages, wherein one of the rotor shafts in the plurality of modular pump stages is the first rotor shaft, wherein the rotor shaft in each modular pump stage is attached to the rotor shaft of an adjacent modular pump stage of the plurality of modular pump stages.

7. The apparatus of claim 1, wherein the apparatus further comprises:

a liner, and radial bearings, wherein the liner is disposed inside of the radial bearings and the liner is a protective shaft sleeve.

8. The apparatus of claim 1, wherein the stator channels comprise holes in the discharge end of the rotor which fluidly communicate with the rotor fluid channels, the rotor fluid channels being symmetrically located along a longitudinal axis of the rotor.

9. The apparatus of claim 1, wherein the apparatus further comprises: two radial bearings in which the first rotor shaft rotates.

10. An apparatus for a submersible screw pump, the apparatus comprising:

a cylindrical pump housing;

a plurality of modular pump stages including a first modular pump stage, the plurality of modular pump stages being positioned between a first end and a second end of the pump housing, the first modular pump stage including:

a cylindrical stator with counter directional screw threads, wherein the cylindrical stator is rotationally fixed inside of the cylindrical pump housing;

a plurality of semicircular channels without rectangular edges formed in the stator;

a cylindrical rotor disposed inside of the stator, wherein the rotor has a screw thread with an opposite direction in relation to the screw threads of the stator, wherein the rotor includes an external surface having a shape and the stator includes an internal surface having the semicircular channels without the rectangular edges to obtain high speed performance of the apparatus with reduced vortices, wherein a gap between the internal surface of the stator and the external surface of the rotor is within a range of 0.1-0.2 millimeters;

a rotor blade formed on the external surface of the rotor, wherein the rotor blade has a curvilinear cross-sectional shape having a first convex shape and a second concave shape, the first convex shaped joined to a second concave shape, wherein the first convex shape is one half the length of the second concave shape;

a rotor shaft causes the rotor to spin;

a discharge end of the rotor is configured with a hole to discharge production fluid from the apparatus;

an intake end on the pump housing is configured with a hole to allow intake of production fluid to the rotor, wherein the production fluid received at the spinning rotor is compressed starting from an initial intake fluid pressure and rising to a higher discharge fluid pressure, wherein the compression of the production fluid creates an axial force on the rotor shaft that is opposite to the direction of fluid flow of the production fluid from the intake end of the rotor to the discharge end of the rotor;

an intake thrust bearing attached to the rotor shaft on the intake end of the first modular pump stage;

a discharge thrust bearing attached to the rotor shaft on the discharge end of the first modular pump stage;

an unloading thrust bearing attached to the rotor shaft positioned between intake thrust bearing and the intake end of the rotor;

a cavity formed in the unloading thrust bearing configured to receive production fluid from the discharge end of the rotor; and rotor fluid channels located inside of the rotor positioned substantially half way between the rotor shaft and an outside edge of the rotor, wherein the rotor fluid channels are arranged between the discharge end of the rotor and the cavity of the unloading thrust bearing, wherein a counter action against an axial force on the rotor shaft is provided by the production fluid disposed in the rotor fluid channels from the discharge end of the rotor into the cavity in the unloading thrust bearing, wherein the production fluid in the cavity presses against the unloading thrust bearing thereby counteracting and reducing the axial force on the rotor shaft.

11. The apparatus of claim 10, wherein the first convex shape is 45 degrees off of a longitudinal axis of the rotor and the second concave shape is 135 degrees off of a longitudinal axis of the rotor.

* * * * *